US007699913B2

(12) United States Patent
Grieve et al.

(10) Patent No.: US 7,699,913 B2
(45) Date of Patent: Apr. 20, 2010

(54) MOISTURE AND ODOR ADSORBING INSERT

(75) Inventors: Scott M. Grieve, Deephaven, MN (US); Daniel M. Schlueter, Victoria, MN (US); James Hill, Minnetrista, MN (US); Craig Dow, Bloomington, MN (US)

(73) Assignee: Big Island Outdoor Group, St. Bonifacius, MN (US)

( * ) Notice: Subject to any disclaimer, the term of this patent is extended or adjusted under 35 U.S.C. 154(b) by 402 days.

(21) Appl. No.: 11/692,527

(22) Filed: Mar. 28, 2007

(65) Prior Publication Data

US 2008/0242538 A1 Oct. 2, 2008

(51) Int. Cl.

| | |
|---|---|
| ***B01D 53/04*** | (2006.01) |
| ***B01D 53/14*** | (2006.01) |
| ***B01D 53/28*** | (2006.01) |
| ***B01J 20/02*** | (2006.01) |
| ***B01J 20/08*** | (2006.01) |
| ***B01J 20/10*** | (2006.01) |
| ***C01B 31/08*** | (2006.01) |
| ***A61L 9/014*** | (2006.01) |

(52) U.S. Cl. ..... 96/147; 502/400; 502/405; 502/414; 502/416; 502/417; 422/4; 422/5; 252/194

(58) Field of Classification Search ..... 96/147; 502/405, 414, 416, 417, 400; 422/4, 5; 252/194

See application file for complete search history.

(56) References Cited

U.S. PATENT DOCUMENTS

| | | | | |
|---|---|---|---|---|
| 3,842,519 | A | 10/1974 | Lapidus | |
| RE29,501 | E | 12/1977 | Lapidus | |
| 4,062,131 | A | 12/1977 | Hsuing | |
| 4,185,402 | A | 1/1980 | Digate | |
| 5,154,960 | A * | 10/1992 | Mucci et al. | 428/68 |
| 5,261,169 | A | 11/1993 | Williford | |
| 5,383,236 | A | 1/1995 | Sesselmann | |
| 5,392,467 | A * | 2/1995 | Moretz et al. | 2/400 |
| 5,539,930 | A | 7/1996 | Sesselmann | |

(Continued)

OTHER PUBLICATIONS

Kohl et al., "Gas Dehydration and Purification by Adsorption," Gas Purification (5th Ed.) (1997), pp. 1034-1035, 1037.*

(Continued)

*Primary Examiner*—Timothy C Vanoy
*Assistant Examiner*—Daniel Berns
(74) *Attorney, Agent, or Firm*—Haugen Law Firm PLLP; Frederick W. Niebuhr

(57) ABSTRACT

An insert for sports gear and footwear has a compliant casing formed of fabric sheeting that incorporates regions of fused or otherwise integral regions of activated carbon. A desiccant such as silica gel in the form of spheroidal beads or other granules is loosely enclosed inside of the casing. The activated carbon has an affinity for odor-causing constituents such as organic compounds, and extracts airborne odor-causing constituents as air enters the casing. Inside the casing, the desiccant extracts airborne water vapor. The two-stage removal of odor-causing constituents and water vapor rapidly and effectively extracts moisture and odors. The silica gel and activated carbon are porous and have high surface areas available for adsorption, whereby the insert is adapted to maintain moisture and odors at low levels during long-term storage.

34 Claims, 2 Drawing Sheets

U.S. PATENT DOCUMENTS

| | | | |
|---|---|---|---|
| 5,790,987 | A | 8/1998 | Sesselmann |
| 5,861,144 | A | 1/1999 | Peterson et al. |
| 5,950,323 | A | 9/1999 | Wroth et al. |
| 5,970,915 | A | 10/1999 | Schlueter et al. |
| 6,009,559 | A | 1/2000 | Sesselmann |
| 6,134,718 | A | 10/2000 | Sesselmann |
| 6,378,224 | B1 | 4/2002 | Qualkinbush et al. |
| 6,861,520 | B1 | 3/2005 | Todd et al. |
| 6,893,632 | B2 | 5/2005 | Johnson |
| 6,922,918 | B2 | 8/2005 | Issler |
| 6,977,589 | B2 | 12/2005 | Loop et al. |
| 7,037,393 | B2 | 5/2006 | Drummond et al. |
| 7,047,667 | B2 | 5/2006 | Klavano |
| 2002/0141898 | A1* | 10/2002 | Carlucci et al. ..... 422/5 |
| 2004/0107474 | A1 | 6/2004 | Sesselmann |

OTHER PUBLICATIONS

Thomas et al., "Odour Absorbing Dressings: A comparative laboratory study." World Wide Wounds, Apr. 1998. Viewed Jun. 4, 2009 at http://www.worldwidewounds.com/1998/march/Odour-Absorbing-Dressings/odour-absorbing-dressings.html.*

* cited by examiner

MOISTURE AND ODOR ADSORBING INSERT

BACKGROUND OF THE INVENTION

The present invention relates to a means for counteracting odors and moisture accumulation in athletic footwear and other sports gear during use, and more particularly to devices insertable into shoes, boots, skates, gloves, shoulder pads, shin pads, sports bags, backpacks and other sports gear to draw moisture and odor-causing components away from their interior and exterior surfaces.

Sports gear, including, but not limited to footwear, has a well known tendency to collect moisture, largely from perspiration when in use, and also between uses when stored in closed containers or humid environments. Extreme or prolonged exposure to moisture can degrade and weaken the materials used in their construction, especially along inside surfaces. In addition, perspiration contains dissolved salts and organic compounds such as urea that can cause unpleasant odors as perspiration accumulates in such materials.

These problems can be more pronounced in athletic footwear due to more active and intensive usage, and also due to more frequent usage as in daily practices or training sessions. The requirements and style of certain athletic footwear can aggravate the problems. For example, the structural integrity required of ice skates results in the use of stronger, less porous material that extends upwardly to include the ankles. Thus, frequently used ice skates are particularly prone to the collection and retention of moisture and odor-causing organic constituents.

There are a variety of known approaches to counteract the moisture and odor accumulation in footwear, including powders and sprays, along with pads or insoles as disclosed in U.S. Pat. No. 4,185,402 (Digade) and U.S. Pat. No. 7,047,667 (Klavano).

U.S. Pat. No. 5,950,323 (Wroth et al.) and U.S. Pat. No. 6,378,224 (Qualkinbush et al.) disclose desiccant-containing devices that can be removably inserted into shoes and other footwear between uses. While both of these devices are said to remove moisture, the Wroth et al. device does not address the need to remove odor-causing constituents. Qualkinbush et al. notes that activated charcoal might be added to its desiccant material, but does not indicate what form the activated charcoal might take or the amount that might be added, nor does it recognize any need or desire to avoid intermingling these components. Specifically, the activated charcoal in granular form lacks the hardness of silica gel and other suitable desiccant materials. Thus, any device containing a mixture of the desiccant and activated charcoal would need to be handled with extreme care to minimize the fracturing, crumbling, and smudging of the charcoal granules that otherwise would occur from contact with the desiccant beads.

Accordingly, the present invention has several aspects directed to one or more of the following objects:

- to provide a moisture and odor removal device that contains a first adsorbent component in the form of a desiccant and a second adsorbent component adapted to adsorb odor-causing constituents, in a manner that prevents any intermingling of these components;
- to provide an insert for athletic equipment and footwear capable of rapidly removing moisture and odors between frequent episodes of use, and with sufficient moisture and odor retention capacity to prevent the accumulation of moisture and odors or bacteria during long-term storage;

- to provide a footwear insert with an outer perimeter stage adapted to collect and retain airborne odor-causing constituents, and an inner stage adapted to collect and retain water vapor; and
- to provide a device insertable into objects that more rapidly and effectively draws moisture and odor-causing constituents away from the material forming inside surfaces of the objects.

SUMMARY OF THE INVENTION

To achieve the foregoing and other objects, there is provided a device positionable within an interior region of an object to attract and accumulate moisture and odors emanating from the object. The device includes a compliant fabric sheeting permeable to air and water vapor and integrally incorporating an adsorbent component adapted to adsorb odor-causing constituents. The fabric sheeting is formed into a closed container. The device further includes a porous adsorbent desiccant in granular solid form, loosely occupying an interior of the container.

The preferred desiccant consists essentially of substantially spheroidal granules having diameters in the range of 1-8 mm. It is advantageous to provide granules that are non-uniform in size, i.e. with different diameters over the size range. This has been found to provide a more effective combination of the volume occupied by the solid desiccant material as compared to the volume and diameters of the interstitial voids between adjacent granules that form passages to accommodate flow of air through the desiccant.

The preferred desiccant is silica (silicon dioxide) gel, which is odorless, non-toxic, non-corrosive, and chemically inert. Silica gel also is non-deliquescent. It does not soften when taking on moisture, and does not tend to compact or agglomerate even when nearly saturated with water. Silica gel has a strong affinity for water, and has a large adsorption capacity due to its high porosity that provides considerable surface area for adsorption, typically ranging from 300 to over 650 square meters per gram of material.

Alternative desiccants include activated alumina (aluminum dioxide), and molecular sieves or crystalline aluminosilicates, such as zeolite. Molecular sieves are relatively expensive, but have a higher adsorption capacity and adsorb water over a wider temperature range. The preferred adsorbent component is activated carbon, which is highly porous to provide a large surface area for adsorption ranging up to 500 square meters per gram of material. Activated carbon has an affinity for a wide variety of dissolved organic compounds, to effectively capture different airborne odor-causing constituents. A particularly effective fabric sheeting is sold under the federally registered trademark SCENT-LOK by Scent-Lok Technologies of Muskegon, Michigan. The sheeting can be fonned of a woven or non-woven polypropylene layer to which particles of the activated carbon are fused. In an alternative approach, the fabric sheeting can incorporate fibers treated with the activated carbon. Further information regarding clothing and accessories formed of the sheeting material can be found in U.S. Pat. No. 5,383,236 (Sesselmann) and related patents. found in U.S. Pat. No. 5,383,236 (Sesselmann) and related patents.

The combination of sheeting that incorporates an adsorbent component and the granular adsorbent desiccant affords several advantages. One of these is the maintenance of lower humidity around and about the odor adsorbing component, which typically operates more effectively in dryer environments.

In addition, the device is configured to remove airborne constituents in two discrete stages: an outer or perimeter stage (the fabric sheeting) for removing odor-causing constituents, and an inner stage (the granular desiccant) for removing water vapor. Air flowing through the device passes first through the outer stage. Accordingly, air reaching the inner stage is relatively free of the odor-causing constituents, although it retains water vapor in amounts comparable to that in the air outside the device. This enhances the vapor removal efficiency of the granular desiccant in any event, due to the lower concentration of odor-causing constituents. Further, this arrangement promotes the use of desiccants with smaller internal pores, e.g. a silica gel known as "Type A" having pore diameters in the range of 2-3 nanometers. As compared to other silica gels with internal pore diameters of up to 12 nanometers, the Type A silica gel more quickly removes larger amounts of airborne water molecules.

In certain embodiments, the fabric sheeting can include one or more layers in addition to the layer impregnated with the activated carbon, in which case an additional layer can function as a barrier between the activated carbon and the silica gel or, more broadly, between the odor adsorbing and moisture adsorbing components. This enhances flexibility by permitting the use of odor adsorbing and desiccant materials that would react or otherwise degrade one another when coming into contact.

Finally, as compared to the material featured in the aforementioned Sesselmann patent in which the primary purpose of the material is to contain odors, the fabric sheeting in the present device can be formed with a higher macroporosity to promote airflow through the device, and can incorporate higher densities of the activated carbon or other odor adsorbing component.

Another aspect of the present invention is an insert for drawing moisture and odors away from interior surfaces of footwear. The insert includes an elongate generally tubular casing having a compliant casing wall formed of a fabric sheeting. The fabric sheeting is permeable to air and water vapor, and integrally incorporates an adsorbent component adapted to adsorb odor-causing constituents. A porous adsorbent desiccant in granular solid form is loosely contained within the casing.

Preferably, the casing wall is substantially inextensible. The casing can consist of a single piece of the fabric sheeting, folded over and stitched closed to form the container. The granular adsorbent desiccant is loosely packed inside the container in the sense that it occupies more than fifty percent and less than ninety percent of the internal volume of the container, and more preferably occupies from seventy to eighty percent of that volume. As a result, the insert is easily bent and otherwise shaped to conform to the interiors of a variety of footwear sizes and styles.

Thus, in accordance with the present invention, a device is insertable into recessed interior spaces of footwear and other objects to counteract the accumulation of moisture and odor-causing constituents. The device maintains moisture-removing and odor-removing components in close proximity, yet prevents their intermingling, ensuring maximum effectiveness of both components while avoiding any degradation or damage that might occur through their intermingling or physical contact. This results in more rapid removal of moisture and odors, coupled with improved capacities for attracting and storing water vapor and odor-causing constituents for long-term storage.

IN THE DRAWINGS

For a further understanding of the foregoing and other advantages, reference is made to the following detailed description and to the drawings, in which.

DETAILED DESCRIPTION OF THE PREFERRED EMBODIMENTS

Figure 1:
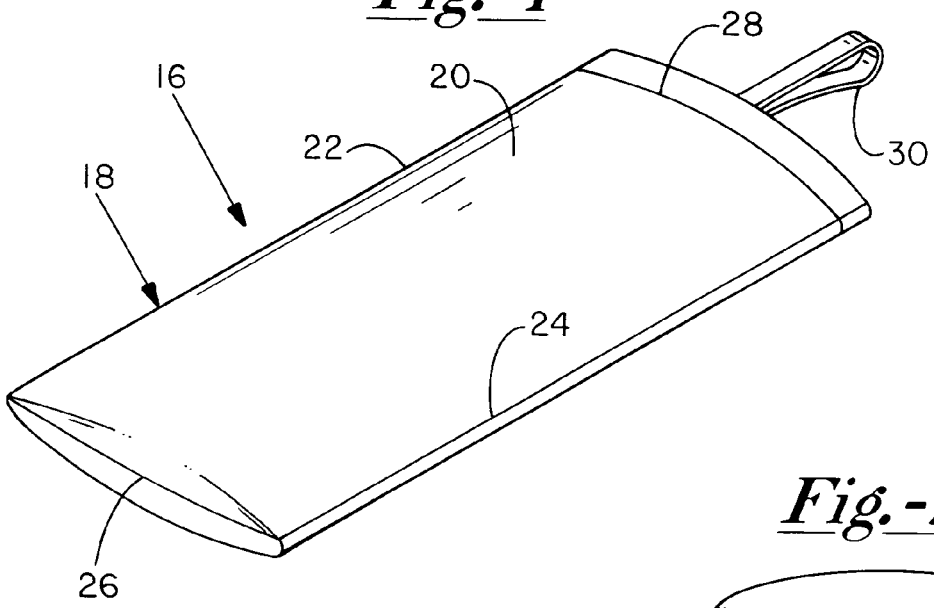
FIG. 1 is a perspective view of a footwear insert constructed according to the present invention.
Figure 2:
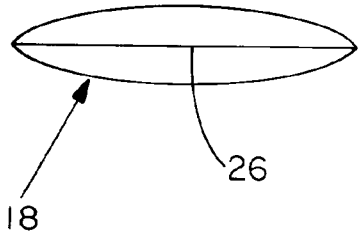
FIG. 2 is an end view of the footwear insert.

Turning now to the drawings, FIGS. 1 and 2 illustrate a footwear insert 16 constructed in accordance with the present invention. The insert includes a container or casing 18, more particularly a closed pouch or bag formed of a compliant cloth or fabric sheeting 20. The fabric sheeting is permeable to air and water vapor. As is apparent from FIG. 1, container 18 can be formed with a single piece or layer of the fabric sheeting, by folding the fabric sheeting along one edge of the container as indicated at 22, by then stitching to form seams including a side edge seam 24, an end seam 26, and an opposite end seam 28 to close the container. End seam 28 also secures a cloth loop 30 provided for convenient carrying and handling of insert 16.

As seen in FIG. 2, a desiccant in granular form, more particularly comprised of substantially spheroidal beads 32, is contained within bag 18. When lying on a flat surface such as a floor or table, insert 16 can assume the shape shown at FIGS. 1 and 2, somewhat resembling a pillow.

Figure 3:
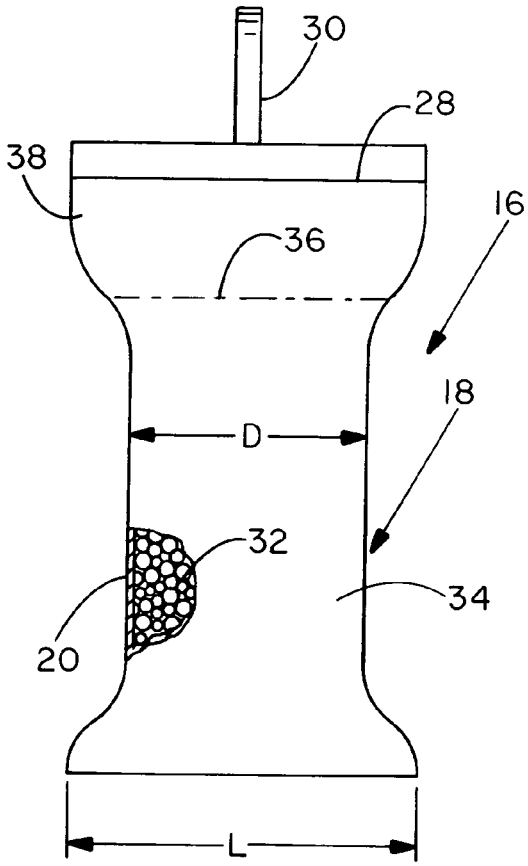
FIG. 3 is a forward elevation of the footwear insert shaped into a substantially tubular configuration.
Figure 4:
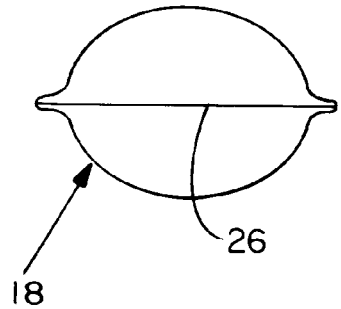
FIG. 4 is an end view similar to that in FIG. 2 showing the footwear insert shaped as in FIG. 3.

Alternatively, the insert can be shaped into a substantially tubular configuration shown in FIGS. 3 and 4. In particular, while end seam 26 has a length L, a tubular body 34 of the container may have a diameter D extending to an upper surface of the desiccant, represented by a broken line 36. In FIGS. 3 and 4, the desiccant beads are maintained in a relatively closely-packed state. An upper portion 38 of bag 18 can be formed into a flap. The flap can have a width W similar to seam length L, being flat and substantially free of the desiccant. Thus, the desiccant beads are loosely packed into to casing 18, occupying more than fifty percent of an interior volume of the casing and less than ninety percent of the interior volume. More preferably, desiccant beads 32 occupy from sixty to seventy-five percent of the internal volume. In the embodiment illustrated, the desiccant occupies about sixty-five percent of the container's internal volume capacity. The length L is about 8 cm and the diameter D is about 5 cm. The reason for somewhat loosely packing the desiccant is to impart a high degree of flexibility to casing 18, in terms of its capacity to be bent, twisted and otherwise shaped to more closely conform to the interior of the skate, boot, or other footwear item for which moisture and odor-control is desired.

The preferred desiccant is comprised of beads 32, although non-spheroidal particles or granules of silica gel could be substituted. Beads 32 have diameters ranging from about 1 mm to about 8 mm. While the beads could be uniform in size, it has been found advantageous to incorporate beads of different sizes distributed over the 1-8 mm range, as this produces a favorable arrangement of interconnected interstitial voids between adjacent beads to allow a free flow of air through the desiccant.

While the voids between beads 32 can conveniently be considered to provide a macroporosity, the desiccant further exhibits a microporosity, in that each of beads 32 incorporates an expansive network of pores having diameters within a range from about 2 to over 12 nanometers. More particularly, silica gel is available in several different ranges of internal pore diameters including a Type A silica gel with pore diameters of 2-3 nanometers; Type B silica gel having pore diameters in the range of about 4-8 nanometers; and Type C silica gel having pore diameters in the range of about 8-12 nanometers. Each type of silica gel has a high porosity to provide extensive area for adsorbing moisture, with an available surface area that increases with diminishing pore diameters. Specifically, Types A, B, and C silica gel have respective surface areas on the order of at least 650, 400-550, and 300-400 square meters per gram of material. While the most suitable type of silica gel can vary with the application, the Type A silica gel is a preferred choice for applications that value rapid removal of moisture during relatively short periods of storage. It is believed that the narrower pores are particularly effective in rapidly extracting and retaining airborne water molecules as air passes through the silica gel.

Silica gel is a preferred desiccant because it is odorless, non-toxic, non-corrosive, and chemically inert. The silica gel spheres also have a high resistance to abrasion and crushing, remaining intact rather than forming a powder or dust when colliding or compressed against one another. The silica gel is non-deliquescent, retaining its firmness and resisting any tendency toward compaction or agglomeration even when nearly saturated with water. Beads 32 have a high affinity for water, and a large adsorption capacity due to the large available surface areas noted above.

Alternative materials for the desiccant include activated aluminum oxide, which also has a high porosity and available surface area for adsorption. Likewise, crystalline aluminosilicates known as molecular sieves, e.g. zeolite, tend to have a higher adsorption capacity but also are more expensive than silica gel or activated alumina.

Figure 5:
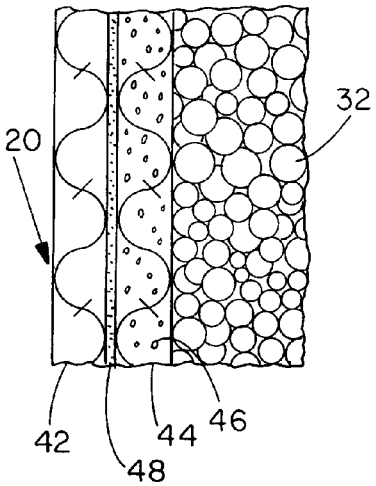
FIG. 5 is an enlarged view showing the desiccant and a fabric sheeting that forms a wall of the footwear insert.

As seen in FIG. 5, fabric sheeting 20 has a composite or layered construction including an outer layer 42 formed of woven or non-woven polypropylene yarn, nylon, cotton, or other suitable material. An inner layer 44 is formed of polypropylene, impregnated through fusion with activated carbon particles 46. As an alternative, fibers treated with activated carbon can be woven into the fabric of inner layer 44. In either event, the activated carbon can be provided at a relatively high density, e.g. over 100 grams per square meter of fabric. The inner and outer layers are bonded to one another with an adhesive layer 48, which of course is applied in a manner to preserve the permeability to air and water vapor. The fabric forming inner and outer layers 44 and 42 preferably is inextensible. If desired, however, these layers can be formed of a resilient material to provide a fabric sheeting that can be stretched to shape casing 18.

In use, insert 16 is placed inside a skate, shoe, or other item of footwear, preferably while being bent, squeezed or otherwise shaped to maximize the extent of insertion into the footwear to position an end, typically the end bearing seam 26, proximate the toe of the skate or shoe while a portion of body 34 is proximate the heel. While portions of outer layer 42 will be in contact with the interior of the skate, there is no need for total or extensive surface contact with the skate interior. In fact, a slight spacing between insert 16 and the skate or shoe may beneficially promote air flow.

With further reference to FIG. 5, the arrows indicate the direction of airflow into insert 16. Outside of the insert, the air carries water vapor and a variety of odor-causing constituents, largely organic gases. As the air flows through outer layer 42 and into inner layer 44, the organic gases encounter activated carbon particles or regions 46. Activated carbon has an affinity for a wide variety of organic compounds. Also, it has a high porosity and therefore a large surface area available for adsorption of the organic constituents. In particular, surface areas usually exceed 400 square meters per gram of material, and can range up to 500 square meters per gram. The pores in the activated carbon tend to have larger diameters than the pores in the silica gel, suitable for collection and retention of the relatively larger molecules of the odor-causing constituents. Accordingly, as the air moves beyond inner layer 44 into the interior of casing 18, it is largely free of the odor-causing constituents.

As the air inside bag 18 travels through the silica gel, airborne water molecules enter the networks of pores within beads 32 and are adsorbed. Thus, odor-causing constituents and moisture accumulate in the activated carbon and silica gel respectively, and the air that emerges from bag 18 is relatively dry and free of the odor-causing constituents.

A salient feature of the invention is the manner in which the activated carbon and silica gel cooperate to remove the airborne constituents. Fabric sheeting 20 provides a first filtering stage for removing the odor-causing constituents, while the silica gel provides a second filtering stage for removing moisture. By drying the air and maintaining a low relative humidity, the silica gel (or other desiccant) prevents moisture levels from rising to a point where they would reduce the odor trapping effectiveness of the activated carbon or other odor-absorbing component. Conversely, by removing many of the airborne odor-causing constituents before the air reaches the silica gel, the activated carbon in fabric sheeting 20 enhances the moisture collection efficiency and capacity of the silica gel. It facilitates the use of desiccants with narrower pores more suited to rapid extraction of water vapor from the air.

Fabric sheeting 20, whether resilient or inextensible, can be modified to enhance performance in several respects. For example, the fabric sheeting may be formed with a wicking fabric, or the fabrics used in forming the sheeting may be treated to enhance wicking action. In another enhancement, the fabric sheeting is treated with an anti-microbial agent, e.g. interwoven threads of bacteria-phobic silver. This does not eliminate odors already produced, but reduces future odors by eliminating or reducing their sources.

Figure 6:
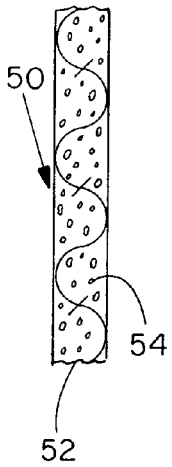
FIGS. 6 and 7 are views similar to FIG. 5 illustrating alternative embodiment footwear inserts.
Figure 7:
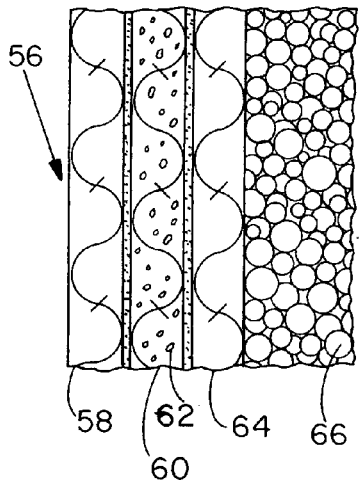

FIGS. 6 and 7 illustrate fabric sheetings of alternative embodiment footwear inserts. In FIG. 6, a fabric sheeting 50 is comprised of a single layer 52 incorporating regions 54 of activated carbon or another component for adsorbing odor-causing compounds.

FIG. 7 illustrates a fabric sheeting 56 consisting of an outer fabric layer 58, an intermediate layer 60 incorporating activated carbon regions 62, and an inner fabric layer 64. The activated carbon regions can be particles or granules fused with the material forming most of layer 60, or may be treated fibers interwoven into layer 60. In this version, inner layer 64 functions as a barrier between activated carbon regions 62 and silica gel beads 66. Accordingly, the footwear insert can incorporate a desiccant and odor-causing adsorbing components that are incompatible in the sense that their physical contact should be avoided.

Figure 8:
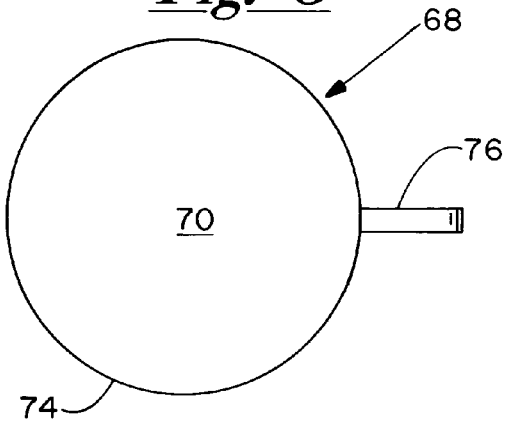
FIG. 8 is a top plan view of an alternative embodiment insert for use with sports gear.
Figure 9:
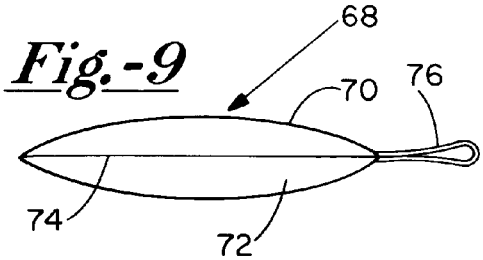
FIG. 9 is a side view of the insert.

FIGS. 8 and 9 illustrate an alternative insert 68 formed of two layers 70 and 72 of a compliant fabric sheeting, secured by a circumferential seam 74 which also secures a cloth loop 76. Layers 70 and 72, similar in construction to fabric sheeting 20, enclose a desiccant which can be comprised spheroidal beads as before, with the resulting insert taking the shape of a circular pillow or hockey puck.

The size of insert 68 depends on the intended use. For example, insert 68 can have a diameter of about 3 inches, suitable for insertion into a hockey glove between uses. A larger insert suitable for use in a duffle bag or athletic equipment bag may have a diameter in the range of 6-9 inches.

Thus, in accordance with the present invention, a footwear insert or other moisture removing device encloses a granular silica gel or other desiccant in a compliant fabric casing impregnated with activated carbon or another component adapted to adsorb odor-causing constituents. The silica gel and activated carbon are maintained in close proximity to one another while being prevented from intermingling. This arrangement operates to the benefit of both components in that each, while performing its intended function, creates an environment more favorable to the effective performance of the other. Both components incorporate intricate networks of submicron pores to provide large surface areas available for adsorption. As a result, the footwear insert is well suited for rapid removal of moisture and odor between uses of the footwear, and for maintaining low levels of moisture and odor-causing constituents during extended periods of storage.

What is claimed is:

1. A device positionable within an interior region of an object to attract and accumulate moisture and odors emanating from the object, including:

a compliant fabric sheeting permeable to air and water vapor and integrally incorporating an adsorbent component adapted to adsorb odor-causing constituents, said fabric sheeting being formed into a closed container; and a porous adsorbent desiccant in granular solid form, loosely occupying an interior of the container;

the fabric sheeting being adapted to remove odor-causing constituents from air moving through the fabric sheeting toward the interior of the container whereby air reaching said interior is substantially free of the odor-causing constituents.

2. The device of claim 1 wherein:

the porous adsorbent desiccant consists essentially of granules having diameters in the range of 2 mm to 8 mm.

3. The device of claim 2 wherein:

the granules are non-uniform in size.

4. The device of claim 2 wherein:

the granules are spheroidal beads.

5. The device of claim 1 wherein:

the porous adsorbent desiccant occupies from about fifty percent to about ninety percent of a volume of said interior of the container.

6. The device of claim 1 wherein:

the porous adsorbent desiccant is selected from the group consisting of: silica gel, activated aluminum oxide, and molecular sieves.

7. The device of claim 6 wherein:

the porous adsorbent desiccant consists essentially of silica gel granules having pores with diameters in the range of 2-12 nm.

8. The device of claim 7 wherein:

the pores have diameters in the range of 2-3 nm.

9. The device of claim 1 wherein:

the fabric sheeting is treated to enhance its wicking action, and further is treated with an anti-microbial agent.

10. The device of claim 1 wherein:

the adsorbent component consists essentially of activated carbon.

11. The device of claim 10 wherein:

the activated carbon is provided at a density exceeding 100 grams per square meter of the fabric sheeting.

12. The device of claim 10 wherein:

the activated carbon is comprised of particles fused to the fabric sheeting.

13. The device of claim 10 wherein:

the fabric sheeting incorporates fibers treated with the activated carbon.

14. The device of claim 1 wherein:

the fabric sheeting forms a barrier separating the adsorbent component from the porous adsorbent desiccant.

15. An insert for drawing moisture and odors away from interior surfaces of athletic equipment, containers, and footwear, the insert including:

an elongate closed casing having a compliant casing wall formed of a fabric sheeting permeable to air and water vapor and integrally incorporating an adsorbent component adapted to adsorb odor-causing constituents; and a porous adsorbent desiccant in granular solid form loosely occupying an interior of the casing;

the casing wall being adapted to remove odor-causing constituents from air moving through the casing wall toward the interior of the casing whereby air reaching said interior is substantially free of the odor-causing constituents.

16. The insert of claim 15 wherein:

the porous adsorbent desiccant consists essentially of beads having a substantially spheroidal shape.

17. The insert of claim 16 wherein:

the beads have diameters in the range of 2-8 mm.

18. The insert of claim 17 wherein:

the beads are non-uniform in size.

19. The insert of claim 15 wherein:

the porous adsorbent desiccant consists essentially of granules with internal pore diameters in the range of 2-12 nm.

20. The insert of claim 19 wherein:

the internal pore diameters are in the range of 2-3 nm.

21. The insert of claim 15 wherein:

the porous adsorbent desiccant is selected from the group consisting of: silica gel, activated aluminum oxide, and molecular sieves.

22. The insert of claim 15 wherein:

the casing wall is substantially inextensible.

23. The insert of claim 15 wherein:

the casing is comprised of a single piece of the fabric sheeting folded to form the casing and closed by stitching.

24. The insert of claim 15 wherein:

the adsorbent component consists essentially of activated carbon.

25. The insert of claim 24 wherein:

the activated carbon adsorbent component is provided at a density exceeding 100 grams per square meter of the fabric sheeting.

26. The insert of claim 15 wherein:

the casing wall forms a barrier separating the adsorbent component from the porous adsorbent desiccant.

27. The insert of claim 15 wherein:

the casing is formable into a substantially tubular shape.

28. The insert of claim 15 wherein:

the porous adsorbent desiccant occupies from fifty percent to ninety percent of an internal volume of the casing.

29. An insert for drawing moisture and odors away from interior surfaces of athletic equipment, containers, and footwear, the insert including:

an elongate closed casing having a compliant casing wall formed of a fabric sheeting permeable to air and water vapor and integrally incorporating an adsorbent component adapted to adsorb odor-causing constituents; and a porous adsorbent desiccant in granular solid form loosely occupying an interior of the casing;

wherein the casing wall forms a barrier separating the adsorbent component from the porous adsorbent desiccant.

30. The insert of claim 29 wherein:

the porous adsorbent desiccant consists essentially of granules with internal pore diameters in the range of 2-3 mm.

31. The insert of claim 29 wherein:

the porous adsorbent desiccant is selected from the group consisting of: silica gel, activated aluminum oxide, and molecular sieves.

32. The insert of claim 29 wherein:

the adsorbent component consists essentially of activated carbon.

33. The insert of claim 32 wherein:

the activated carbon adsorbent component is provided at a density exceeding 100 grams per square meter of the fabric sheeting.

34. The insert of claim 29 wherein:

the porous adsorbent desiccant occupies from sixty to seventy-five percent of an internal volume of the casing.

* * * * *